US007775379B2

(12) United States Patent
Hodge

(10) Patent No.: US 7,775,379 B2
(45) Date of Patent: Aug. 17, 2010

(54) RETAIL DISPLAY FOR GREETING CARDS

(75) Inventor: Gary A. Hodge, Rutherfordton, NC (US)

(73) Assignee: American Greetings Corporation, Cleveland, OH (US)

( * ) Notice: Subject to any disclaimer, the term of this patent is extended or adjusted under 35 U.S.C. 154(b) by 157 days.

(21) Appl. No.: 11/542,582

(22) Filed: Oct. 3, 2006

(65) Prior Publication Data

US 2008/0078728 A1 Apr. 3, 2008

(51) Int. Cl.
*A47F 7/14* (2006.01)
*A47B 57/58* (2006.01)

(52) U.S. Cl. ..... 211/55; 100/108; 100/61

(58) Field of Classification Search ..... 211/40, 211/43, 50, 51, 52, 55, 78, 85.26, 94.01, 211/103, 128.1, 184, 190, 207; 248/235, 248/243, 50; 40/124, 124.05, 124.14, 124.16, 40/124.2, 128.1; 108/60, 61, 108; 312/138, 312/206, 408
See application file for complete search history.

(56) References Cited

U.S. PATENT DOCUMENTS 570,657 A * 11/1896 Beckwith ..... 108/61
1,135,038 A * 4/1915 Middaugh ..... 312/287
1,883,827 A * 10/1932 Bales ..... 108/60
1,997,829 A * 4/1935 Mckee ..... 211/55
2,333,717 A * 11/1943 Heed et al. ..... 312/50
2,532,600 A * 12/1950 Broersma ..... 211/55
2,678,793 A * 5/1954 Brochstein ..... 248/243
2,688,409 A * 9/1954 Echlin ..... 211/184
2,798,617 A * 7/1957 Schreiber ..... 108/32
2,938,634 A * 5/1960 Ganz ..... 211/55
2,982,423 A * 5/1961 Handler et al. ..... 211/126.1
3,179,479 A * 4/1965 Freedman ..... 312/140.3
3,298,538 A * 1/1967 Ganz et al. ..... 211/184
3,335,874 A * 8/1967 Levy et al. ..... 211/193
3,425,568 A * 2/1969 Albright ..... 211/87.01
3,612,292 A * 10/1971 Nervig ..... 211/184
3,706,150 A * 12/1972 Greenberger ..... 40/661.03
3,777,897 A 12/1973 Gray
3,892,450 A * 7/1975 Kolster et al. ..... 312/117
4,122,955 A * 10/1978 Celms ..... 211/133.5
4,401,222 A * 8/1983 Kulikowski et al. ..... 211/94.01
4,573,749 A * 3/1986 Massaro ..... 211/40
4,613,047 A * 9/1986 Bushyhead et al. ..... 211/55
4,712,694 A * 12/1987 Breslow ..... 211/184
4,735,324 A * 4/1988 Wilcek ..... 211/184
4,949,849 A * 8/1990 Hardy ..... 211/55
5,048,698 A * 9/1991 Konrad ..... 211/45
5,148,925 A * 9/1992 Althoff et al. ..... 211/40
5,184,737 A * 2/1993 Hardy ..... 211/55
5,199,579 A 4/1993 Van Duyne
5,272,991 A * 12/1993 Carrigan, Jr. ..... 108/108

(Continued)

*Primary Examiner*—Michael Safavi
*Assistant Examiner*—Joshua Rodden
(74) *Attorney, Agent, or Firm*—James C. Scott; Roetzel & Andress

(57) ABSTRACT

A greeting card display has frame-supported rails and card shelves with laterally adjustable dividers which form multiple adjustable card pockets for display and storage of greeting cards and envelopes. The number of card shelves and pockets can be easily set-up and altered by any desired arrangement of the card shelves and dividers. The card shelves can be use in combination with other types of product displays on the same supporting frame.

1 Claim, 3 Drawing Sheets

U.S. PATENT DOCUMENTS 5,473,833 A 12/1995 Ostrovsky
5,499,727 A * 3/1996 Koch ..... 211/193
5,505,315 A * 4/1996 Carroll ..... 211/59.2
5,511,675 A * 4/1996 Frederick ..... 211/193
5,572,822 A * 11/1996 Lynch et al. ..... 40/642.02
5,641,081 A * 6/1997 Merl ..... 211/103
5,667,083 A * 9/1997 Schnoor et al. ..... 211/41.12
5,682,824 A * 11/1997 Visk ..... 108/60
5,720,396 A 2/1998 Wegscheid et al.
5,769,247 A * 6/1998 Merl ..... 211/103
5,938,048 A * 8/1999 Carroll et al. ..... 211/55
5,984,117 A 11/1999 Smith
6,112,912 A * 9/2000 Lord et al. ..... 211/55
6,142,322 A 11/2000 Smith et al.
6,305,559 B1 * 10/2001 Hardy ..... 211/184
6,412,648 B1 * 7/2002 Woolnough et al. ..... 211/128.1
6,422,403 B1 * 7/2002 Woolnough et al. ..... 211/55
6,439,399 B1 8/2002 Wegstein et al.
6,530,485 B1 3/2003 Weber
6,659,295 B1 * 12/2003 De Land et al. ..... 211/187
6,698,603 B2 * 3/2004 Lawson et al. ..... 211/94.01
7,028,851 B1 * 4/2006 Fenger ..... 211/40
7,287,350 B2 * 10/2007 Fast et al. ..... 40/642.02
2001/0025823 A1 * 10/2001 Brozak ..... 211/55
2002/0162810 A1 11/2002 Wegstein et al.
2003/0106867 A1 * 6/2003 Caterinacci ..... 211/40
2003/0189018 A1 * 10/2003 Hopkins et al. ..... 211/90.02
2004/0055187 A1 3/2004 Kerker et al.
2004/0074855 A1 4/2004 Wons et al.
2004/0140276 A1 7/2004 Waldron
2005/0067362 A1 * 3/2005 Martin et al. ..... 211/87.01
2005/0139561 A1 * 6/2005 Ohkubo ..... 211/128.1
2005/0218092 A1 10/2005 Rosen
2006/0043038 A1 * 3/2006 Wetzel et al. ..... 211/88.03
2006/0186063 A1 * 8/2006 Campbell ..... 211/55
2007/0170126 A1 * 7/2007 Singer et al. ..... 211/55
2007/0256997 A1 * 11/2007 Collins et al. ..... 211/184

* cited by examiner

RETAIL DISPLAY FOR GREETING CARDS

FIELD OF THE INVENTION

The invention is in the general field of retail displays and merchandising systems, and more particularly displays and merchandising systems for paper and printed products.

BACKGROUND OF THE INVENTION

Greeting card displays in retail stores have taken many forms designed to neatly present a wide variety of cards in a compact arrangement. Common features of such displays are successive rows of card shelves, tiered or vertical, with dividers on each shelf which define card pockets. The shelves are attached to and supported by a back panel which is supported upon a vertically oriented frame, sometimes referred to as a "gondola". The frame may include two spaced-apart upright members with multiple attachment points, and an upright member is attached to span between the upright members. The dividers may be also attached to the back panel, or to the shelves. In some displays, the shelves and dividers may be rigidly attached to a back panel by fasteners, so that any assembly or adjustment of the display requires removal and re-attachment of such fasteners. Also, the spacing of the shelves and dividers is constant, so that there is little or no flexibility to accommodate cards of different sizes in the same display.

Another disadvantage of existing displays is the use of a single piece back panel on which the rows are formed. In a tiered display for example, the back panel is typically a single piece in which multiple tiers are molded to form the card rows. The vertical spacing of the rows is thus fixed with no provision for adjustment to accommodate cards of different sizes. When the back panel is a single homogeneous piece, additional structure must be attached to the panel to form a front to the card pockets P, necessitating fasteners along each row to secure the front to the back panel. This increases the complexity and cost of the display. Also, in displays where the card pocket dividers are in the form of clips which are secured to the fronts of the card pockets P, such clips tend to be rather small and insubstantial and do not form well-defined pockets which neatly hold and display cards.

SUMMARY OF THE INVENTION

The present invention overcomes these and other disadvantages of prior art greeting card displays, and provides substantial structural and operative improvements to such displays. In accordance with one general construction concept of the display, a series of horizontal rails are installed to span between upright members of a frame. Each rail is configured to support a card shelf. Card pockets P are formed along each card shelf by dividers which engage with the card shelf. Each of the rails and corresponding card shelf can be independently located at a unique elevation upon the upright members of the frame. The card shelves have multiple structural features which enable engagement with a corresponding rail and the card pocket dividers. In one embodiment, the rails are made of metal, and the card shelves are made of plastic. When formed as channels, the card shelves may be made as extrusions, such as plastic extrusions. Although described in the context of retail display of greeting cards and envelopes, the display can of course be utilized for storage and display of any other products which can be supported by the display.

DETAILED DESCRIPTION OF PREFERRED AND ALTERNATE EMBODIMENTS

Figure 1:
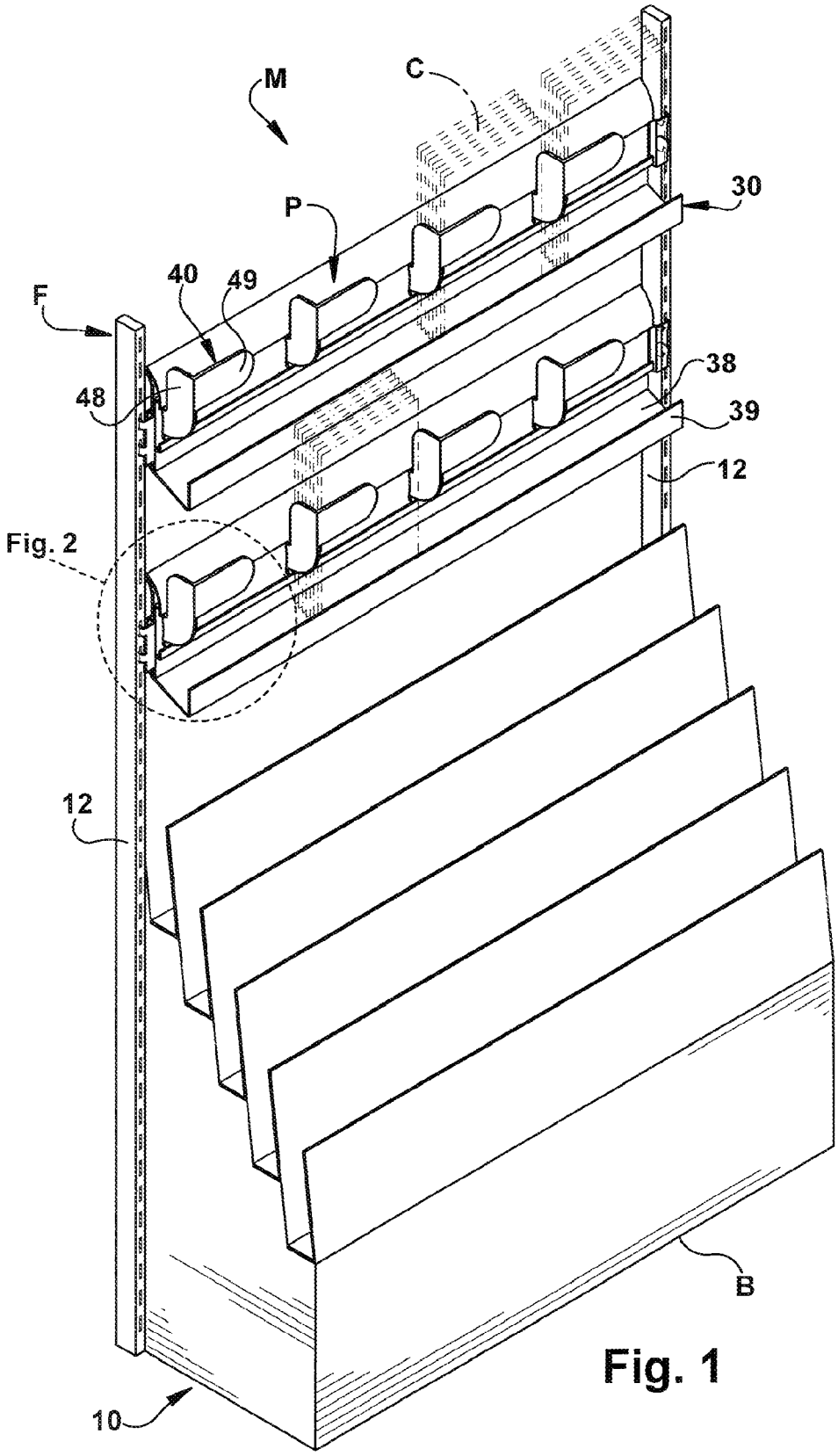
FIG. 1 is a perspective view of a representative greeting card display configured in accordance with the disclosure.

With reference to the Figures, and in particular FIG. 1, there is illustrated a greeting card display, indicated generally at 10, which is configured for display of multiple greeting cards C (shown in phantom) in multiple card pockets P in a retail shopping environment such as along aisles in a retail store. The display 10 is in the form of one module M or gondola (i.e., a freestanding structure for displaying merchandise in a retail establishment) which can be used alone or in combination with multiple modules of the same or dissimilar configuration, the most common arrangement being multiple modules arranged side-by-side along a store aisle. Each module M is defined by a base B upon which a frame F is supported. The frame F includes two spaced apart upright members 12 which generally define the width and height of the module M. The present disclosure is not limited to any particular width or height dimensions of the frame F or module M or other components. In one form, the upright members 12 are channel pieces with periodically spaced slots 14 arranged vertically along the length of the members.

Figure 3:
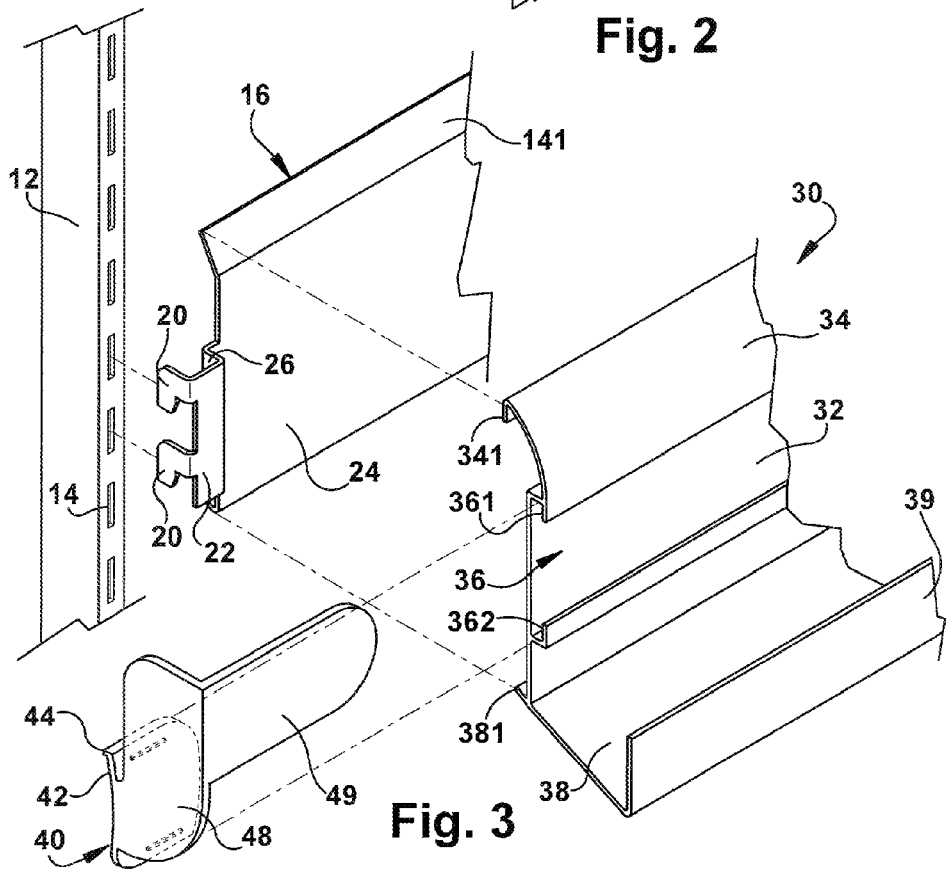
FIG. 3 is an exploded perspective view of the greeting card display of FIG. 1.

Spanning between and engaged with the upright members 12 are one or more rails 16. As shown in FIG. 3, the ends 18 of the rails 16 are configured to engage with the upright members 12. In one embodiment, the ends 18 include one or more brackets 20 which fit within slots 14. The brackets 20 are formed at one side of a channel 22 which projects from a plane or planar section 24 of the rail 16. The channel 22 projects from planar section 24 by a web 26 which is generally perpendicular to plane 24. The web projects forward from plane 24 so that the planar section 24 is recessed with respect to a front surface 122 of the upright members 12 in which the slots 14 are formed. In addition to planar section 24, the rail 14 also has an angled upper flange 141 which extends from the top of planar section 24 and which in this embodiment is angled slightly back from the front of planar section 24. At a bottom edge of planar section 24 there is an angled lower flange 142 which extends away from the planar section 24. The depth of the upright members 12 allows for recess of the plane 24 and the angled upper flange 141. Also the location of the planar section 24 between the upright members adds to the structural rigidity of the frame F of the module M. The height of the rail 16 extends over three or four or more slots 14 of the upright members 12. Multiple rails 16 can be attached to a pair of upright members 12.

Figure 4:
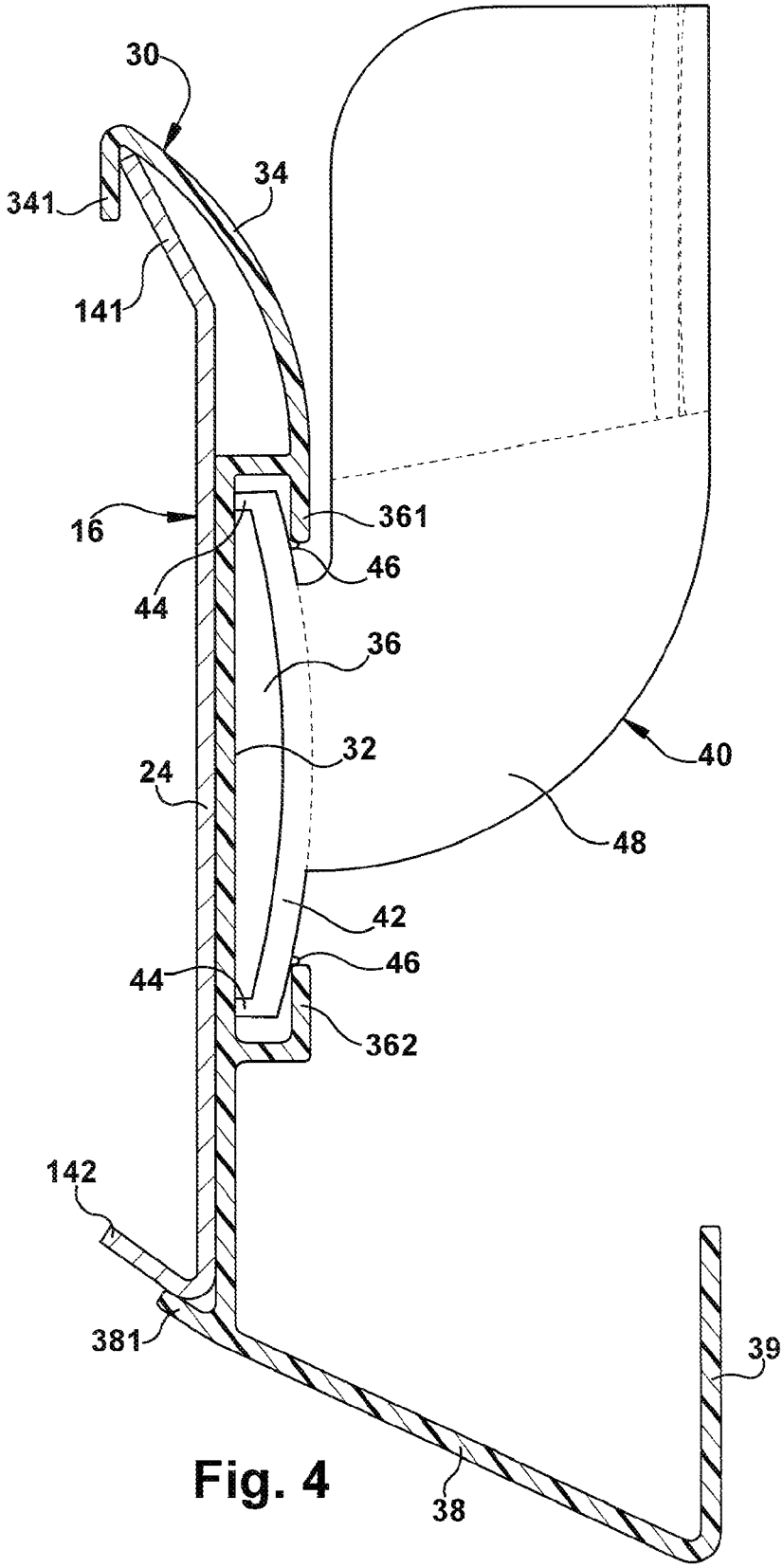
FIG. 4 is a profile view of a portion of the greeting card display of FIG. 1, in the direction of the arrows indicated in FIG. 2.

To form card shelves upon the rails 16, the display further includes card shelves 30 which engage with the rails 16. FIGS. 3 and 4 illustrate one end of a card shelf 30 and the manner of engagement with the corresponding rail 16. Each card shelf 30 has a planar back 32, a top section 34, a channel 36 formed by an upper web 361 and a lower web 362, a shelf bottom 38 and a shelf front 39. The card shelf 30 engages with the rail 16 by a flange 341 which extends over a top edge of the angled upper flange 141, and by a rearward projection 381 of the shelf bottom 38 which fits over a bottom edge and over the angled lower flange 142 of the rail 16. The planar back 32 of the card shelf 30 thus fits flush against the front surface of the of the plane 24 of rail 16. The shelf bottom 38 projects forward to an extent which will accommodate at least several cards and envelopes in a stacked arrangement.

Figure 2:
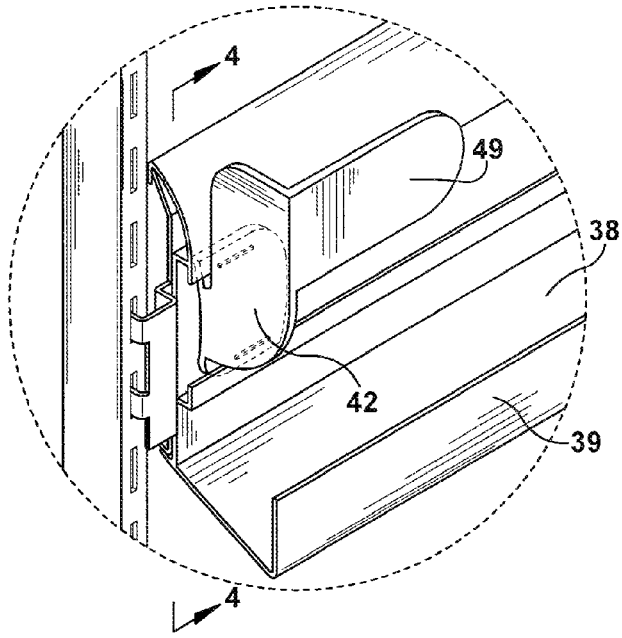
FIG. 2 is a perspective view of a portion of the greeting card display of FIG. 1.

To form individual card pockets P along the card shelves 30, there are provided dividers 40 which engage with the channel 36 of the card shelves 30. The dividers 40 have a base 42 which fits within the channel 36 of the card shelves 30. In one form, as shown for example in FIGS. 2-4, the base 42 of the dividers 40 is an arcuate plane with terminal ends 44 which contact the interior of channel 36, and an outer surface of the base 42 contacting the webs 361 and 362 of channel 36. This creates frictional engagement of the base 42 of the dividers 40 within the channel 36 of the card shelf 30. Stop projections 46 may also be formed on the outer surface of the base 42 for additional contact with the webs 361 and 362, to secure the divider 40 in a desired location along the length of channel 36. Extending outwardly and generally perpendicular from the base 42 is a flange 48 which resides in a generally vertical plane relative to the card shelf bottom 38, thereby providing an orthogonal surface which works in conjunction with the underlying shelf bottom 38 to form a pocket for one or more cards and envelopes. As shown in FIG. 4, the size of the flange 48 may be substantial relative to the card shelf 30 and shelf bottom 38, and may extend outward over the entire projection of the shelf bottom 38, and upward to and beyond the top section 34 of the card shelf 30. In the embodiment shown, the flange 48 provides a vertical planar surface with substantial surface area which provides a side wall to a card pocket. The divider 40 also has a front tab 49 which extends perpendicular from the flange 48 and generally aligned with the card shelf 30 and parallel to the back 32 of the card shelf 30. The front tab 49 can also have substantial area relative to the area of the card shelf to which it is opposed, and forms a front wall to a card pocket which is formed by the engagement and cooperation of the card shelf 30 and the divider 40. The front tab 49 is generally oriented in a vertical plane parallel to or vertically aligned with the shelf front 39 of the card shelf 30. The lateral extent of the front tab 49 relative to the flange 48 may vary depending upon dimensional requirements, but preferably has an extent which is sufficient to adequately retain one or more greeting cards and envelopes upon the card shelf 30. As shown in FIG. 1, multiple dividers 40 can be engaged and positioned with a single card shelf 30 to form multiple card pockets P in the display.

The bases 42 of each of the dividers 40 are slidable within the channel 36 so that the width of a card pocket P can be adjusted. Frictional contact of the terminal ends 44 and the stop projections 46 with the channel 36 maintains the dividers 40 in position within the channel 36.

Although described to this point as separate components, the disclosure further includes the concept of constructing the rail and corresponding card shelf as a single integral or integrated structure which is attached or attachable directly or indirectly to a supporting frame. For example, the described brackets 22 or other fastener or engagement structure could be integrally molded with ends of the card shelf and its other described features, such as the divider-receiving channel 36, the shelf bottom 38 and shelf front 39. Multiple card shelves can be made in this form, together or in combination, and arranged vertically or tiered upon supporting upright frame members, and in combination with other product-supporting structures.

What is claimed is:

1. A greeting card display configured for display of multiple greeting cards in multiple card pockets in a retail shopping environment, the display having at least one module which is configured to be used alone or in combination with multiple modules of the same or dissimilar configuration, each at least one module defined by a base upon which a frame is supported, the frame having two spaced apart upright members which generally define the width and height of the at least one module, wherein the upright members have periodically spaced slots arranged vertically along the length of the upright members;

one or more rails spanning between and engaged with the upright members with ends of the one or more rails having one or more brackets mechanically engaged with the slots in the upright members, the brackets formed at one side of a rail channel which projects from a plane of the rail, the rail channel projecting from the plane of the rail by a web which is generally perpendicular to the plane of the rail, the web projecting forward from the plane of the rail so that the plane of the rail is recessed with respect to a front surface of the upright members;

the rail further comprising an angled upper flange which extends from a top of the plane of the rail, the angled upper flange being angled slightly back from the front of the plane of the rail, and an angled lower flange at a bottom edge of the rail which extends away from the plane of the rail;

one or more card shelves engaged with one of the one or more rails, each of the one or more card shelves having a planar back, a top section, a card shelf channel having an upper web and a lower web, a card shelf bottom and a card shelf front, each of the one or more card shelves engaged with the one or more rails by a flange which extends over a top edge of the angled upper flange of the one or more rails, and by a rearward projection of the card shelf bottom which fits over a bottom edge and over the angled lower flange of the rail, the planar back of each of the one or more card shelves positioned substantially flush against the front surface of the plane of the rail, the shelf bottom projection forward to an extent which is adapted to accommodate at least several cards and envelopes in a stacked arrangement;

a plurality of dividers located in each of the one or more card shelves and engaged with each of the card shelf channels, each divider having an arcuate plane base configured to fit within the card shelf channel of the one or more card shelves, terminal ends extending from the arcuate base which contact an interior of card shelf channel, and an outer surface of the arcuate plane of the base contacting webs of the card shelf channel, and stop projections formed in the outer surface of the base for additional contact with the webs of the card shelf channel, whereby frictional contact of the terminal ends and the stop projections of the divider with card shelf channel maintains the dividers in position within the card shelf channel, each divider further comprising a flange which extends outwardly and generally perpendicular from the base, the flange being oriented vertically and perpendicular to the card shelf bottom, whereby the flange of each divider provides an orthogonal structure with respect to the one or more rails, the divider base and the card shelf bottom forming a pocket for one or more rails, the divider base and the card shelf bottom forming a pocket for one or more cards and envelopes, each of the dividers further comprising a front tab which extends perpendicularly and laterally from the flange and generally aligned with the one or more card shelves and spaced from and parallel to the back of the one or more card shelves, the tab forming a front wall to the card pocket which is formed by the engagement and cooperation of the divider with one of the one or more card shelves.

* * * * *